United States Patent [19]

Crowe

[11] 4,039,031

[45] Aug. 2, 1977

[54] WELL CONTROL VALVE APPARATUS

[75] Inventor: Talmadge L. Crowe, Houston, Tex.

[73] Assignee: Baker Oil Tools, Inc., Orange, Calif.

[21] Appl. No.: 652,483

[22] Filed: Jan. 26, 1976

[51] Int. Cl.[2] ..... E21B 43/12

[52] U.S. Cl. ..... 166/317; 166/321

[58] Field of Search ..... 166/224 R, 117.5, 317, 166/321; 137/71, 512, 512.3, 628, 797

[56] References Cited

U.S. PATENT DOCUMENTS

| | | | |
|---|---|---|---|
| 2,144,144 | 1/1939 | Crickmer | 137/155 |
| 3,124,151 | 3/1964 | Lilly | 137/155 |
| 3,654,949 | 4/1972 | McMurry | 137/155 |
| 3,693,644 | 9/1972 | Dilorenzo | 137/71 |
| 3,698,411 | 10/1972 | Garrett | 137/71 |
| 3,722,527 | 3/1973 | Blackwell | 137/155 |

*Primary Examiner*—James A. Leppink

[57] ABSTRACT

Well control valve to be installed in a tubing string for use in killing a well through use of fluid under pressure pumped down through the annulus surrounding the tubing string. When the annulus pressure exceeds a predetermined value, the valve is opened to permit the kill fluid to flow into and through the tubing string into the producing formation. The valve contains a closure member or disc, the upstream side of which is subject to the normal hydrostatic pressure of the fluid in the annulus, and also to an increase in the pressure of the annulus fluid above normal hydrostatic pressure, but its downstream side is subjected to atmospheric pressure initially. Accordingly, the closure member can be placed in its opened condition, as by rupturing it, when subjected to a predetermined increase in annulus pressure above the normal hydrostatic pressure, allowing the annulus kill fluid to flow into and through the tubing string to the producing formation.

21 Claims, 6 Drawing Figures

WELL CONTROL VALVE APPARATUS

The present invention relates to well control valves, and more particularly to control valves adapted to be incorporated in a tubing string to control the flow of fluid between a tubing-casing well annulus and the interior of the tubing string.

Control valves have been incorporated in tubing strings which are opened, when required, to establish communication between a well casing annulus surrounding a tubing string and the interior of the tubing string, for the purpose of killing a well by reverse circulation; that is, pumping kill fluid through the annulus and tubing string into the well formation. An example of a well control valve used heretofore includes a shear disc that ruptures when subjected to a predetermined differential pressure between the tubing-casing annulus pressure and the tubing pressure. During acidizing of the well, the tubing pressure may be much higher than the formation pressure or pressure of the fluid in the tubing-casing annulus. When the well is being produced, the tubing pressure may be much lower than the original well shut-in pressure. Because of different well conditions that might be encountered, the shear value of the disc must be sufficiently high to withstand the high tubing pressures associated with the well acidizing operations. As a result, a high casing-annulus pressure is required to rupture or shear the disc when the well is to be killed. This annulus pressure also varies as the tubing pressure changes, as under the different conditions above noted.

With control valves embodying the present invention, increase in the annulus pressure required to actuate the valve is predetermined and is not influenced by changes in the tubing pressure. Moreover, increases in tubing pressure and decreases in temperature, as might occur during well stimulation operations, do not affect the operation of the valve. The well control valve is actuated upon increase in the annulus pressure above the normal hydrostatic pressure of the fluid in the tubing-casing annulus. This increase in annulus pressure can be effected by applying pressure to the annulus fluid from the surface of the well bore. It could result from other conditions, such as a leak in the tubing string below the Christmas tree, which would allow the tubing string pressure to be imposed on the annulus fluid and add its pressure to the hydrostatic annulus fluid pressure to open the valve. If, for example, a tubing leak develops near the surface of the gas well, the bottom hole gas pressure, if sufficiently high, would produce opening of the valve, permitting the kill fluid in the annulus to be imposed on the formation and kill the well and the gas flow therefrom. If the well is not killed, the excessive casing pressure will be relieved. In the absence of such automatic opening of the valve by the high pressure gas, the latter would add to the original hydrostatic pressure in the annulus and might overpressure the casing or collapse the tubing.

Another aspect of the invention is to provide valves having larger openings for the passage of the kill fluid. Unless fluid can enter the tubing from the annulus at a high rate, it may not be killed since the kill fluid might flow with the formation fluid through the tubing to the surface.

Another object of the present invention is to provide valves which are insensitive to tubing pressure, since they will be opened upon the addition of a predetermined annulus pressure to the normal hydrostatic head of fluid in the annulus, and regardless of the tubing pressure or drastic fluctuations in the tubing pressure.

Yet another object of the invention is to provide valves embodying a rupturable disc, the annulus pressure acting against the upstream side of the disc and atmospheric pressure against the downstream side. As a result, the tripping pressure of the valve is a function of the strength of the disc, and no compensation for tubing pressure or temperature fluctuations need be made.

Relatively simple valve discs can be provided, and this fact, coupled with the fact that other valve parts are relatively inexpensive, makes the entire valve economical to manufacture.

In one version of the invention, the kill valve embodies a check valve feature, which permits fluid to flow from the tubing-casing annulus into the tubing, but prevents fluid in the tubing from flowing into the casing.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings:

FIG. 1 is a diagrammatic type of view of a valve apparatus incorporated in a tubing string disposed in a well bore, parts being disclosed in side elevation and parts in longitudinal section;

FIGS. 2*a* and 2*b* together constitute an enlarged longitudinal section, parts being disclosed in side elevation, taken along the line 2—2 on FIG. 1, FIG. 2*b* being a lower continuation of FIG. 2*a;*

Figure 1:
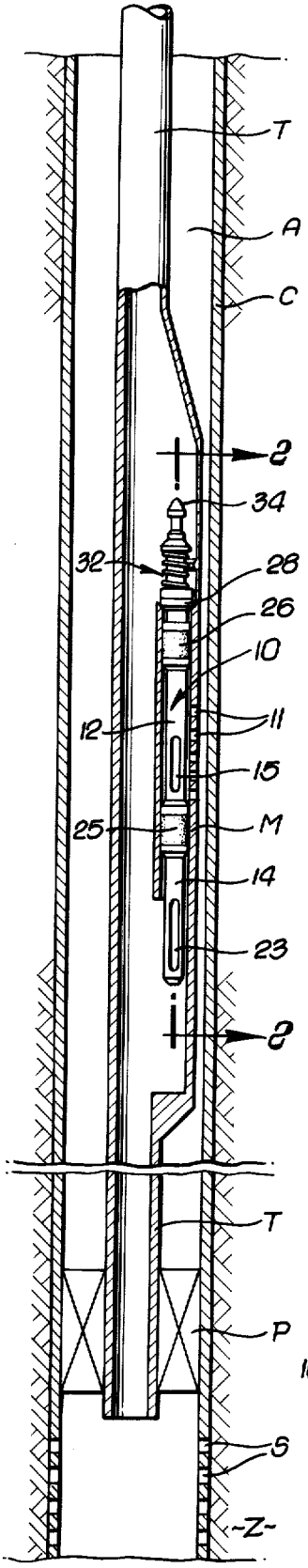

As disclosed in FIG. 1, a well production tubing string T is disposed within a well casing C, the lower end of the tubing string being appropriately sealingly related to a well packer P set in packed-off condition within the well casing above a plurality of casing perforations S that permit production from a formation zone Z to flow into the well casing, and thence into the lower end of the tubing string for conveyance therethrough to the top of the well bore. The apparatus illustrated in FIG. 1 is diagrammatic in form for purpose of illustration.

A well control valve 10 is disposed in the tubing string, and more particularly in its side pocket mandrel M, which, as is well known in the art, is disposed to one side of the tubing string so as to leave an uninterrupted passage through the entire tubing string. The side pocket mandrel and valve 10 are preferably located near and above the well packer P. Fluid in the tubing-casing annulus A can pass through a plurality of openings or perforations 11 in the side pocket M to its interior, and, when the well control valve 10 is open, downwardly through the valve and into the interior of the tubing string.

Figure 2A:
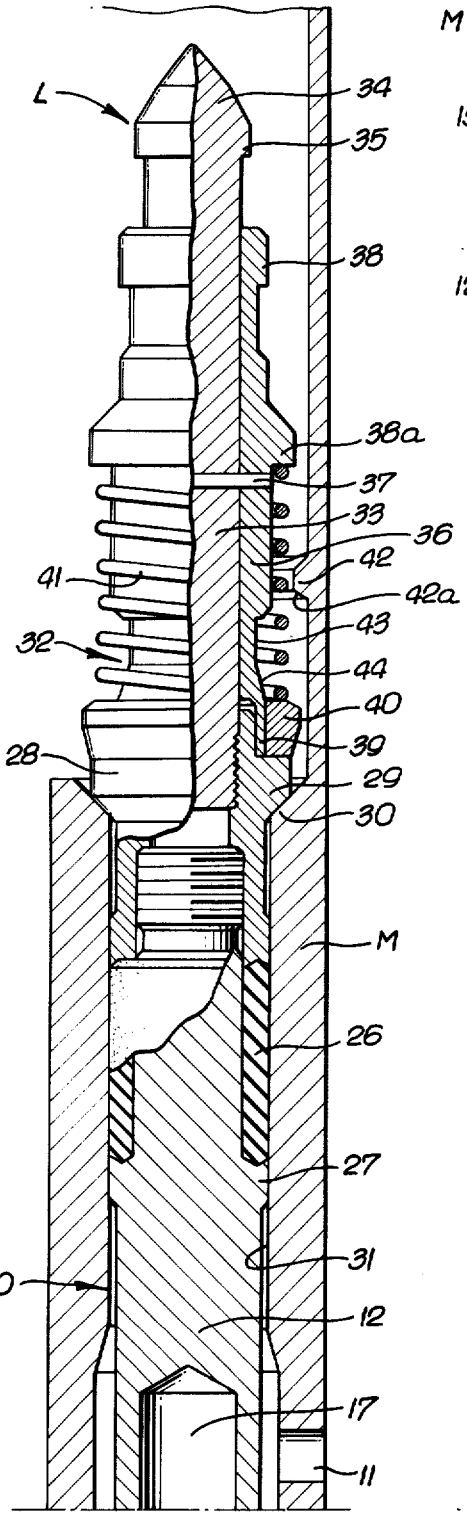
Figure 2B:
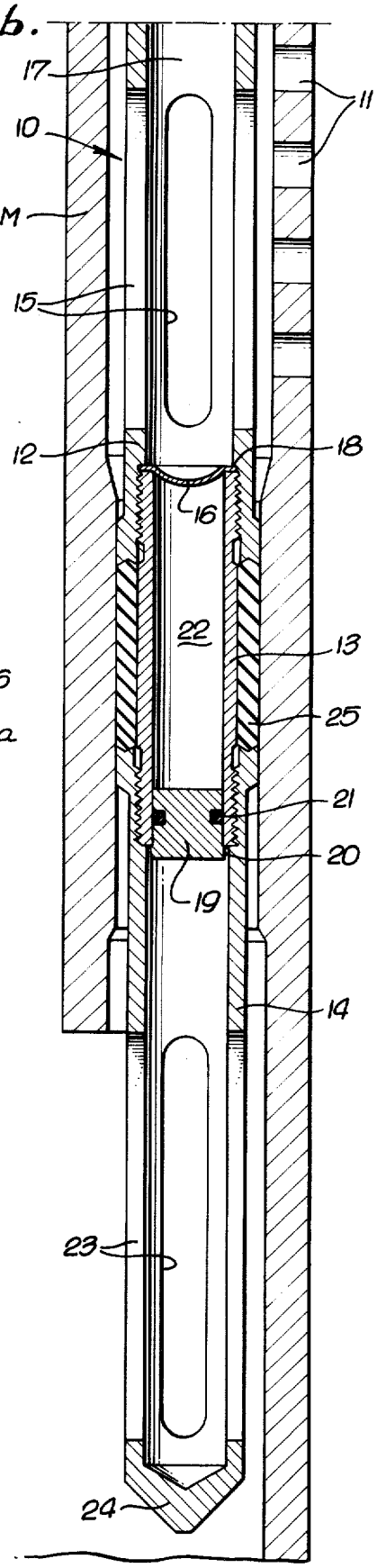

As specifically illustrated in FIGS. 2*a* and 2*b*, the valve apparatus includes an upper body portion 12, the lower end of which is threadedly secured to a lower body portion or mandrel 13, the lower end of which is, in turn, threadedly attached to a tubular plug catcher 14. Fluid flowing from the annulus A through the side pocket perforations 11 can pass through the relatively large inlet perforations or slots 15 in the body, but initially cannot flow downwardly from the body because of the presence of a rupturable disc 16 extending across the body passage 17, this disc being firmly secured at its outer portion between the upper end of the mandrel 13 and a downwardly facing shoulder 18 formed in the lower portion of the body. As shown, this disc is of concave form, and is made of a rupturable material so as to fracture or be disrupted when subjected to a predetermined pressure differential. The lower portion of the mandrel 13 is initially closed by a plug 19 having a lower flange 20 bearing against the lower end of the mandrel, a suitable seal ring 21 being mounted on the plug for sealing against the inner wall of the mandrel 13. The upper disc 16 and lower plug 19 initially form a confined chamber 22 which may contain air at atmospheric pressure, or other suitable gas.

The plug catcher 14 is elongate, having relatively large outlet openings, perforations or slots 23 therein. When the disc 16 is ruptured, fluid pressure thereabove can act upon the plug and eject it from the mandrel 13, the plug dropping to the lower end of the catcher which acts as a stop 24. Under the condition just described, fluid can flow through the side pocket perforations 11 and body perforations 15 to the interior of the latter, passing downwardly through the initially atmospheric chamber 22 in the mandrel and into the catcher 14 for discharge through the outlet openings or perforations 23 into the interior of the tubing string T.

A lower packing unit 25 is mounted on the mandrel 13, being confined between the upper end of the catcher 14 and the lower end of the body 12; whereas, an upper packing 26 is disposed on the body, being confined between a shoulder 27 on the body and the lower end of an adapter 28 threadedly secured to the upper end of the body, this adapter having an external flange 29 adapted to engage a companion landing shoulder or seat 30 in the side pocket mandrel. When the adapter 28 seats on the landing shoulder 30, the upper packing unit 26 sealingly engages the inner wall 31 of the side pocket above its perforations 11, the lower packing unit 13 engaging the inner wall of the side pocket below the perforations 11.

As disclosed, the valve apparatus 10 can be installed initially in the tubing string T before the latter is run into the well casing C and into sealing relation to the well packer P, or it can be lowered through the tubing string and into the side pocket mandrel M to seat in the latter in a position disclosed in the Figures after the tubing string is in place. A suitable latch for a retrievable flow control device L of a known type is disclosed in the drawings, which is specifically illustrated and described in U.S. Pat. No. 3,827,493, and which per se forms no part of the present invention. As shown, a retrievable latching device 32 includes the adapter 28 threadedly connected to the upper end of the body, and which rests on the landing shoulder 30. This adapter is threadedly secured to the lower end of a locking rod or stem 33 having a pointed head 34 and a shoulder 35 at the lower end of the head, to be engaged with a suitable running tool (not shown) for lowering the valve apparatus in the tubing string and into the side pocket mandrel M. A locking sleeve 36 is slidably mounted on the rod or stem 33, being initially secured thereon by a transverse shear pin 37 in the lower position disclosed in FIG. *2a*, in which its lower end engages the adapter 28. The upper end of this sleeve includes a shoulder 38 to be engaged by a pulling tool (not shown) for releasing the latching apparatus and removing it from the side pocket mandrel and through the well production tubing T to the top of the well bore. The lower end of the sleeve 36 has an enlargement 39 which can be surrounded by a locking ring 40, which is urged to its lower position disclosed in FIG. *2a* by a helical compression spring 41 bearing against the ring with its upper end seating against a shoulder 38*a*.

When the latching device 32 is lowered through the tubing string T, the valve apparatus 10 will pass into the side pocket M and the lock ring 40 will engage a latching shoulder 42 in the side pocket disposed above the landing shoulder 30, the locking ring 40 being prevented from moving downwardly past the locking shoulder 42. The remainder of the latch device 32 continues to move downwardly with respect to the ring 40 to remove the enlargement 39 from the ring until a smaller diameter portion 43 of the locking sleeve, disposed above a bevelled sleeve shoulder 44 extending upwardly from the enlargement 39, permits the locking ring to be cammed laterally by the latching shoulder 42. The locking ring 40 can then move past the latch shoulder 42. Once below the latch shoulder, the helical spring 41 will expand and shift the lock ring 40 to its lowermost position in which it surrounds the sleeve enlargement 39, retaining the lock ring in a position for engagement with the inclined lower portion 42*a* of the latching shoulder, which will limit the extent of upward movement of the valve 10 in the side pocket M.

When the valve 10 is to be released and removed from the side pocket, a suitable pulling tool (not shown) is lowered through the tubing string T, passing over the locking sleeve 36 into a position of engagement with the sleeve shoulder 38; whereupon an upward pull can be taken on the locking sleeve 36 to elevate the entire apparatus in the side pocket until the lock ring 40 engages the latching shoulder 42. An increase in the upward pull will then shear the shear pin 37 and cause the locking sleeve to move upwardly limited by its engagement with the rod shoulder 35, shifting the sleeve enlargement 39 above the locking ring 40 and permitting the latter to shift laterally out of engagement from the latching shoulder 42, thereby effectively releasing the entire valve mechanism 10 in the side pocket mandrel for removal through the tubing string T to the top of the well bore.

With the valve apparatus in place, the disc 16 is initially intact and will prevent any fluid from entering the chamber 22 defined between the disc and the lower plug 19, this chamber remaining at atmospheric pressure, although, if desired, a suitable gas, such as nitrogen, can be provided in the chamber under a desired low pressure above atmospheric (FIGS. *2a*, *2b*). Assuming the chamber to contain air at atmospheric pressure, the disc is subject to the pressure of the fluid in the annulus A between the well production tubing T and the casing C. The disc is not subject to the pressure of the fluid in the tubing string T because of the presence of the upper and lower packing or seal units 26, 25 disposed on opposite sides of the side pocket perforations 11. Fluid pressure in the tubing string is not exerted on the valve apparatus, since it is pressure balanced the landing shoulder 30 of the side pocket mandrel supporting the valve apparatus in position.

Figure 3:
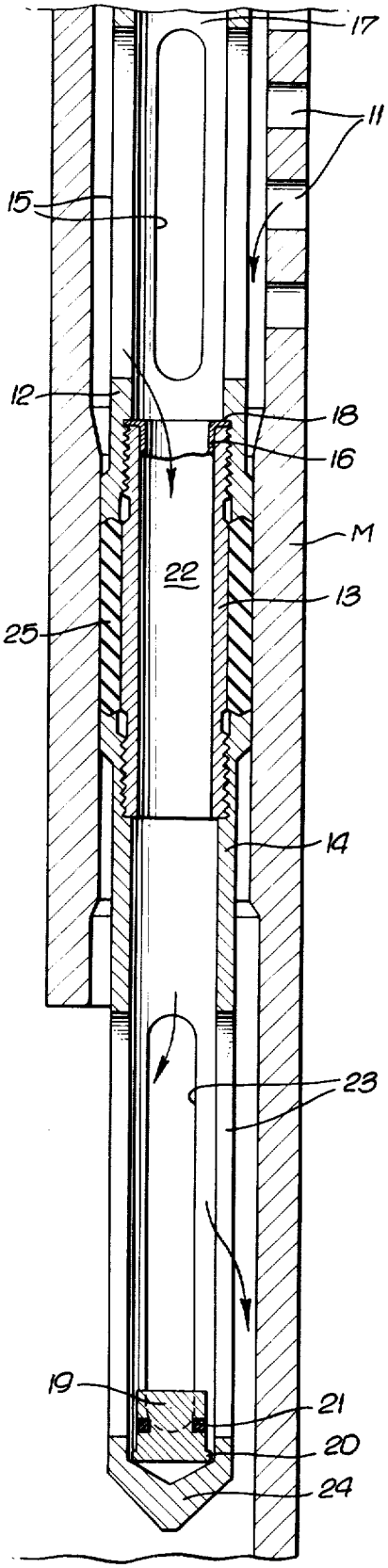
FIG. 3 is a view similar to FIG. 2*b* disclosing the valve in open condition.

The rupturable disc is selected to fracture at a predetermined pressure in excess of the hydrostatic pressure of the fluid in the tubing-casing annulus. As an example, discs may be used having a pressure rating of 3,000, 3,500, 4,000, 8,000, 9,000, etc. psi. The pressure rating of the disc selected will be much greater than the hydrostatic pressure of the fluid in the tubing-casing annulus. When the disc is to be ruptured, the annulus fluid pressure is increased above the normal hydrostatic pressure. When the pressure rating of the disc is exceeded, it will rupture and the hydrostatic head of fluid and the increase in the pressure of the fluid provided at the surface will pass into the atmospheric chamber 22 and eject the plug 19 from the mandrel, the plug dropping to the bottom of the catcher 14 and fully opening the outlet openings or perforations 23 (FIG. 3). The kill fluid can then be pumped down through the annulus A and through the open valve apparatus and into the tubing string T, from where it will exert its force against the fluid under pressure in the well production zone. Sufficient fluid can be pumped through the annulus A into the well to kill the well.

In the event the tubing string T leaks, communication will be established between the interior of the tubing string and the tubing-casing annulus A. Higher pressure fluid in the well production tubing can then pass into the tubing-casing annulus and increase its pressure. If the total pressure in the annulus then exceeds the pressure rating of the disc 16, the latter will be disrupted and permit the kill fluid in the tubing-casing annulus to flow through the valve 10 into the tubing string, providing an offsetting pressure to kill the well. If the pressure in the casing C, resulting from the tubing leak, were to become excessive, the fluid under pressure would be relieved by the opening of the control valve 10.

Figure 4:
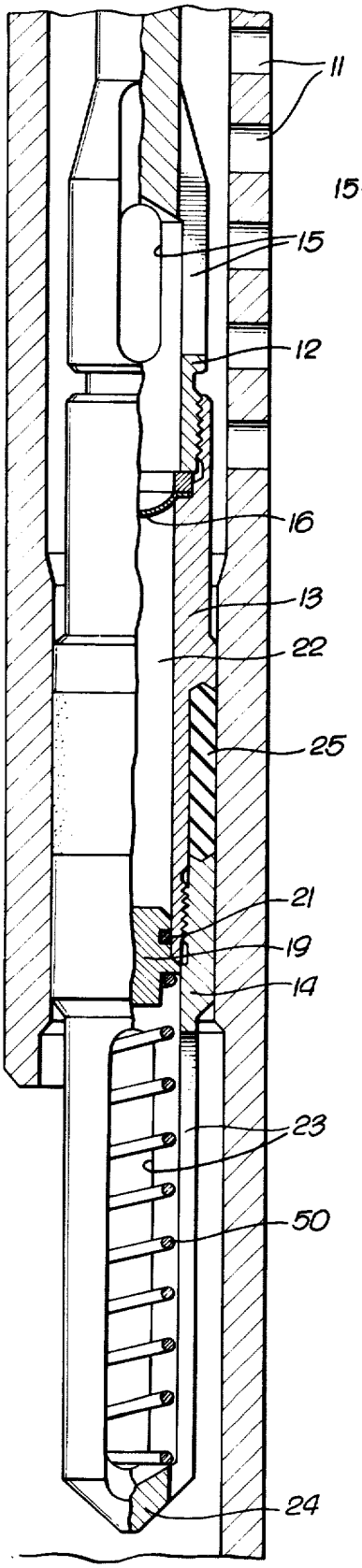
FIG. 4 is a view similar to FIG. 2*b* of a modified form of valve apparatus, with the valve in closed condition.
Figure 5:
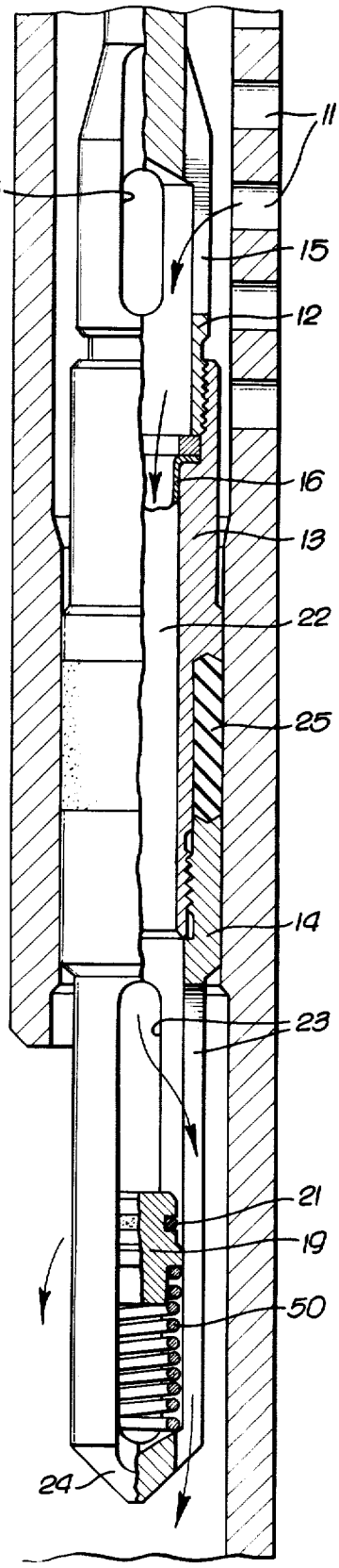
FIG. 5 is a view of the valve apparatus of FIG. 4 in open condition.

As disclosed in FIG. 4, a helical compression spring 50 is mounted in the tubing catcher 14, its lower end shouldering against the bottom 24 of the catcher and its upper end bearing against the closure or plug 19. When the disc 16 is ruptured (FIG. 5), the annulus fluid will pass into the chamber 22 and shift the plug 19 downwardly against the force of the helical spring 50, which may be a relatively light spring, the fluid continuing to pass through the catcher openings 23 and then to the tubing string T to kill the well. In the event the annulus pressure is relieved sufficiently, the spring 50 will shift the plug or check valve 19 back into its sealing position in the lower end of the mandrel 13, thereby preventing fluid in the tubing string T from entering the casing C through the control valve 10.

It is, accordingly, apparent that a well control valve has been provided, in which opening of the valve is independent of the tubing pressure, since the downstream side of the disc is exposed to atmospheric pressure only, and not to the tubing pressure. The total pressure at which the disc 16 is to rupture for the purpose of opening the valve is predetermined and the appropriate strength or thickness of disc selected. It is only necessary to increase the pressure of the fluid in the annulus A sufficiently above the hydrostatic pressure of the fluid to effect rupture of the disc. This increase in pressure is completely independent of the pressure present in the tubing string. The openings and passages through the valve 10 are large, which permits the kill fluid to be pumped into the well at a high rate, overcoming any tendency for the well to continue producing despite the pumping of kill fluid through the annulus into the well at a comparatively low rate. As indicated above, the control valve can be incorporated in the tubing string before the latter is run into the well bore, or it can be lowered into place after it has been appropriately related to the well packer in the well bore above the casing perforations. After the well has been killed, the valve is readily retrievable by use of a suitable pulling tool that becomes connected to the latching device. Another control valve can then be lowered through the tubing string into appropriate position to effect a closure between the tubing-casing annulus A and the interior of the tubing string T.

By employing the atmospheric chamber 22, a constant base pressure is provided on the upstream side of the rupturable disc 16 against which the annulus pressure acts. The tripping pressure of the disc is a function of the strength of the disc only, and is in no manner affected by tubing pressure, inasmuch as the tubing pressure cannot act on the disc at all, nor is it affected by temperature fluctuations.

I claim:

1. Control valve apparatus for use in a tubular string disposed in a well bore having a producing formation: comprising a valve body structure having an inlet opening, an outlet opening, and a fluid passage between said openings, first closure means in said body structure to one side of said inlet opening fully closing said passage, said first closure means being subject to fluid pressure in said inlet opening only and movable to open position when subjected to a predetermined increase in fluid pressure in said inlet opening, second closure means in said body structure to one side of said outlet opening and spaced from said first closure means to initially fully close said passage simultaneously with closing of said passage by said first closure means to provide a confined portion of said passage between said first and second closure means into which fluid internally and externally of the tubing string cannot enter, said second closure means being subject to fluid pressure in said outlet opening only, subjecting said first closure means to said predetermined fluid pressure effecting opening of said confined portion of said passage to permit said fluid pressure to enter said confined portion and shift said second closure means to open position permitting fluid flow through said inlet opening, confined portion, and outlet opening.

2. Control valve apparatus as defined in claim 1; said first closure means comprising a disruptable disc secured in said body structure and extending across said passage.

3. Control valve apparatus as defined in claim 1; said confined portion of said passage initially containing a gas at substantially atmospheric pressure.

4. Control valve apparatus as defined in claim 1; said first closure means being below said inlet opening and at the upper end of said confined passage portion, said second closure means being above said outlet opening and at the lower end of said confined passage portion.

5. Control valve apparatus as defined in claim 1; said first closure means comprising a disruptable disc secured in said body structure and extending across said passage, said confined portion of said passage initially containing a gas at substantially atmospheric pressure.

6. Control valve apparatus as defined in claim 1; said second closure means comprising a plug extending across said passage and shiftable longitudinally in said passage by fluid pressure in said confined passage portion to a position opening said outlet opening.

7. Control valve apparatus as defined in claim 1; said second closure means comprising a plug extending across said passage and shiftable longitudinally in said passage by fluid pressure in said confined passage portion to a position opening said outlet opening, and spring means urging said plug to its position closing said confined passage portion.

8. Control valve apparatus for use in a tubular string disposed in a well bore having a producing formation: comprising a valve body structure having an inlet opening, an outlet opening, and a fluid passage between said openings, first closure means in said body structure to one side of said inlet opening closing said passage and movable to open position when subjected to a predetermined fluid pressure in said inlet opening, second closure means in said body structure to one side of said outlet opening and spaced from said first closure means to provide a confined portion of said passage between said first and second closure means into which fluid internally and externally of the tubing string cannot enter, subjecting said first closure means to said predetermined fluid pressure effecting opening of said confined portion of said passage to permit said fluid pressure to enter said confined portion and shift said second closure means to open position permitting fluid flow through said inlet opening, confined portion, and outlet opening; said first closure means being below said inlet opening and at the upper end of said confined passage portion, said second closure means being above said outlet opening and at the lower end of said confined passage portion, the first closure means comprising a disruptable disc secured in said body structure and extending across said passage.

9. Control valve apparatus as defined in claim 8; said confined portion of said passage initially containing a gas at substantially atmospheric pressure.

10. Control valve apparatus for use in a tubular string disposed in a well bore having a producing formation: comprising a valve body structure having an inlet opening, an outlet opening, and a fluid passage between said openings, first closure means in said body structure to one side of said inlet opening closing said passage and movable to open position when subjected to a predetermined fluid pressure in said inlet opening, second closure means in said body structure to one side of said outlet opening and spaced from said first closure means to provide a confined portion of said passage between said first and second closure means into which fluid internally and externally of the tubing string cannot enter, subjecting said first closure means to said predetermined fluid pressure effecting opening of said confined portion of said passage to permit said fluid pressure to enter said confined portion and shift said second closure means to open position permitting fluid flow through said inlet opening, confined portion, and outlet opening; said first closure means comprising a disruptable disc secured in said body structure and extending across said passage; said second closure means comprising a plug extending across said passage and shiftable longitudinally in said passage by fluid pressure in said confined passage portion to a position opening said outlet opening.

11. Control valve apparatus as defined in claim 10; said confined portion of said passage initially containing a gas at substantially atmospheric pressure.

12. Control valve apparatus as defined in claim 10; said confined portion of said passage initially containing a gas at substantially atmospheric pressure, said disc being below said inlet opening and at the upper end of said confined passage portion, said plug being above said outlet opening and at the lower end of said confined passage portion.

13. Control valve apparatus as defined in claim 10; said confined portion of said passage initially containing a gas at substantially atmospheric pressure, said disc being below said inlet opening and at the upper end of said confined passage portion, said plug being above said outlet opening and at the lower end of said confined passage portion, and spring means urging said plug to its position closing said confined passage portion.

14. Apparatus for controlling fluid flow in a well bore from a producing formation: comprising a tubular string disposed in the well bore and communicating with said producing formation, a valve device in the tubular string for controlling fluid flow between the well bore annulus surrounding said tubular string and the interior of said tubular string, including a valve body structure having an inlet opening communicating with the well bore annulus, an outlet opening communicating with the interior of said tubular string, and a fluid passage between said openings, first closure means in said body structure to one side of said inlet opening fully closing said passage, said first closure means being subject to fluid pressure in said inlet opening only and movable to open position when subjected to a predetermined increase in pressure in said annulus and inlet opening, second closure means in said body structure to one side of said outlet opening and spaced from said first closure means to initially fully close said passage simultaneously with full closing of said passage by said first closure means to provide a confined portion of said passage between said first and second closure means into which fluid from said annulus and fluid from said tubular string cannot enter, said second closure means being subject to fluid pressure in said outlet opening only, subjecting said first closure means to said predetermined fluid pressure in said annulus effecting opening of said confined portion of said passage to permit said fluid pressure to enter said confined portion and shift said second closure means to open position permitting fluid flow from said annulus through said inlet opening, confined portion, and outlet opening to the interior of said tubular string.

15. Apparatus as defined in claim 14; said first closure means comprising a disruptable disc secured in said body structure and extending across said passage.

16. Apparatus as defined in claim 14; said confined portion of said passage initially containing a gas at substantially atmospheric pressure.

17. Apparatus as defined in claim 14; said first closure means being below said inlet opening and at the upper end of said confined passage portion, said second closure means being above said outlet opening and at the lower end of said confined passage portion.

18. Apparatus for controlling fluid flow in a well bore from a producing formation: comprising a tubular string disposed in the well bore and communicating with said producing formation, a valve device in the tubular string for controlling fluid flow between the well bore annulus surrounding said tubular string and the interior of said tubular string, including a valve body structure having an inlet opening communicating with the well bore annulus, an outlet opening communicating with the interior of said tubular string, and a fluid passage between said openings, first closure means in said body structure to one side of said inlet opening closing said passage and movable to open position when subjected to a predetermined pressure in said annulus and inlet opening, second closure means in said body structure to one side of said outlet opening and spaced from said first closure means to provide a confined portion of said passage between said first and second closure means into which fluid from said annulus and fluid from said tubular string cannot enter, subjecting said first closure means to said predetermined fluid pressure in said annulus effecting opening of said confined portion of said passage to permit said fluid pressure to enter said confined portion and shift said second closure means to open position permitting fluid flow from said annulus through said inlet opening, confined portion, and outlet opening to the interior of said tubular string; said first closure means comprising a disruptable disc secured in said body structure and extending across said passage, said second closure means comprising a plug extending across said passage and shiftable longitudinally in said passage by fluid pressure in said confined passage portion to a position opening said outlet opening.

19. Apparatus as defined in claim 18; said confined portion of said passage initially containing a gas at substantially atmospheric pressure.

20. Apparatus as defined in claim 18; said confined portion of said passage initially containing a gas at substantially atmospheric pressure, said disc being below said inlet opening and at the upper end of said confined passage portion, said plug being above said outlet opening and at the lower end of said confined passage portion.

21. Apparatus as defined in claim 18; said confined portion of said passage initially containing a gas at substantially atmospheric pressure, said disc being below said inlet opening and at the upper end of said confined passage portion, said plug being above said outlet opening and at the lower end of said confined passage portion, and spring means urging said plug to its position closing said confined passage portion.

* * * * *